US008794683B2

(12) United States Patent
Wysong

(10) Patent No.: US 8,794,683 B2
(45) Date of Patent: Aug. 5, 2014

(54) SLIDE ACCESS AND LATCH ENGAGEMENT FOR A DOOR

(76) Inventor: David R. Wysong, Goshen, IN (US)

( * ) Notice: Subject to any disclaimer, the term of this patent is extended or adjusted under 35 U.S.C. 154(b) by 244 days.

(21) Appl. No.: 13/017,144

(22) Filed: Jan. 31, 2011

(65) Prior Publication Data

US 2012/0192497 A1 Aug. 2, 2012

(51) Int. Cl.
*E05B 1/00* (2006.01)
*E05B 3/00* (2006.01)

(52) U.S. Cl.
USPC ..... 292/347; 292/1; 292/336.3

(58) Field of Classification Search
USPC ..... 292/1, 137, 163, 174, 175, 336.3, 347; 49/61–63, 70, 449, 460
See application file for complete search history.

(56) References Cited

U.S. PATENT DOCUMENTS

| | | | | | |
|---|---|---|---|---|---|
| 170,792 | A | * | 12/1875 | White et al. | 126/289 |
| 232,984 | A | * | 10/1880 | Lewin | 126/289 |
| 362,805 | A | * | 5/1887 | Williams | 292/175 |
| 1,172,205 | A | | 2/1916 | Gillentine | |
| 1,519,962 | A | * | 12/1924 | Hardiman | 49/449 |
| 1,578,598 | A | * | 3/1926 | Gidney | 292/175 |
| 1,581,776 | A | * | 4/1926 | Altschul | 211/4 |
| 1,686,819 | A | * | 10/1928 | Kirschbaum | 160/96 |
| 2,172,649 | A | * | 9/1939 | Claus | 49/62 |
| 2,537,896 | A | * | 1/1951 | Hinton et al. | 292/1 |
| 3,288,200 | A | * | 11/1966 | Gagne | 160/180 |
| 3,317,231 | A | | 5/1967 | Lindquist | |
| 3,737,184 | A | | 6/1973 | Swarth | |
| 3,832,805 | A | * | 9/1974 | Stevens | 49/503 |
| 3,906,669 | A | * | 9/1975 | Vorguitch | 49/372 |
| 4,094,099 | A | | 6/1978 | Birch | |
| 4,621,848 | A | | 11/1986 | Pierce | |
| 6,009,932 | A | | 1/2000 | Smith | |
| 6,242,064 | B1 | * | 6/2001 | Howie, Jr. | 428/35.7 |
| 6,793,254 | B1 | * | 9/2004 | Galvin | 292/163 |
| 7,270,352 | B1 | | 9/2007 | Stuart | |
| 7,448,668 | B2 | | 11/2008 | Brabeck | |
| 2006/0255596 | A1 | | 11/2006 | Yong | |
| 2007/0138810 | A1 | | 6/2007 | Armbrustmacher | |

FOREIGN PATENT DOCUMENTS

| | | | | | |
|---|---|---|---|---|---|
| GB | 2029491 | A | * | 3/1980 | E05B 1/00 |

* cited by examiner

*Primary Examiner* — Carlos Lugo
(74) *Attorney, Agent, or Firm* — Barnes & Thornburg LLP

(57) ABSTRACT

A combined slide access and latch engagement for a door. A panel is in the door proximate a latch for the door, with the panel having a slide portion that is displaceable to permit access to the latch. A knob is located on the slide and has a grip protruding from one side to allow the slide to be slid to permit access to the latch or, using a latch strike extending from the slide, engage the latch to open the door. A spring is used to maintain the knob in an actuation orientation.

14 Claims, 3 Drawing Sheets

SLIDE ACCESS AND LATCH ENGAGEMENT FOR A DOOR

BACKGROUND OF THE INVENTION

This invention relates to access doors, and in particular to a combined slide access and latch engagement for a door typically used for access to a recreational vehicle.

A typical recreational vehicle has a screen door that opens outwardly and, due to space limitations, has a latch only on the outside. For access to the latch from the interior, the screen door includes a slide which, when displaced, allows a person to engage the latch from inside the recreational vehicle, thus permitting opening and closing of the door.

Screen door slides are common, and examples are found in the following U.S. published applications and patents: US 2007/0138810; U.S. Pat. Nos. 7,448,668; 6,009,932 and 4,094,099.

The invention is directed to a simple slide access that permits the user to not only grasp the door latch for opening and closing the door, but also, by means of the slide knob, open the door without ever physically grasping the latch.

SUMMARY OF THE INVENTION

The invention provides a combined slide access and latch engagement for a door. The door has a latch on one side, with a panel in the door proximate the latch. The panel includes a slide displaceable to permit access to the latch through a panel aperture. A knob is located on the slide, with the knob including a grip protruding from one side of the slide and a latch strike extending from an opposite side of the slide in registration with the latch when the slide is in a closed position. A bias is provided to maintain the knob in an actuation orientation.

In accordance with the preferred form of the invention, the latch strike comprises a finger protruding from the knob. When the knob is moved downwardly, the finger engages the latch, permitting the door to be opened.

In one form of the invention, the bias comprises a spring. The spring is mounted in a channel in the knob, and extends in the channel between a slide contact and a knob contact. The knob contact is proximate the latch strike, while the slide contact is the bottom portion of an opening in the slide.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
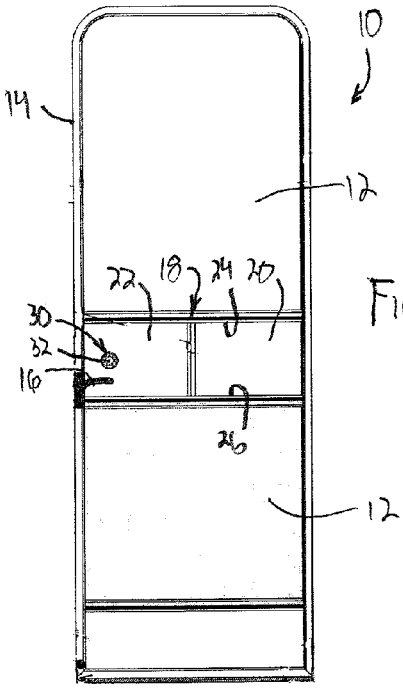
FIG. 1 is an elevational illustration of a typical door employing the invention, viewed from what is normally the exterior side.

A typical door according to the invention is shown generally at 10 in the drawing figures. The door 10 is not shown installed in a recreational vehicle, although those skilled in the art will readily understand its mounting and function. The door 10, as illustrated, is a screen door, and includes screens 12 mounted in an outer frame 14. A latch 16 is located on one side of the door 10, and the door 10 is hingedly mounted (not illustrated) in an appropriate fashion on the side opposite the latch 16 when installed in a recreational vehicle. All of this is conventional and is therefore not described in greater detail.

Figure 2:
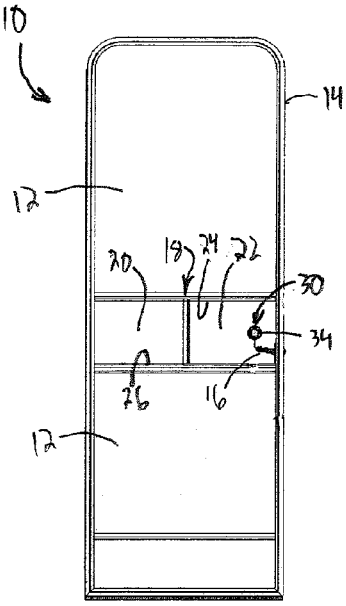
FIG. 2 is an elevational view similar to FIG. 1, but from the opposite side.

The door 10 includes a central panel 18. The panel 18 is in two parts, a fixed portion 20 and a slide 22. The slide 22 is mounted in upper and lower tracks 24 and 26 for sliding to permit physical access through the door 10 to the latch 16 from the interior, which is the side illustrated in FIG. 2. The panel 18 shown in FIGS. 1 and 2 is transparent, with the latch 16 thus being visible therethrough, although obviously the panel 18 can be translucent or opaque.

Figure 4:
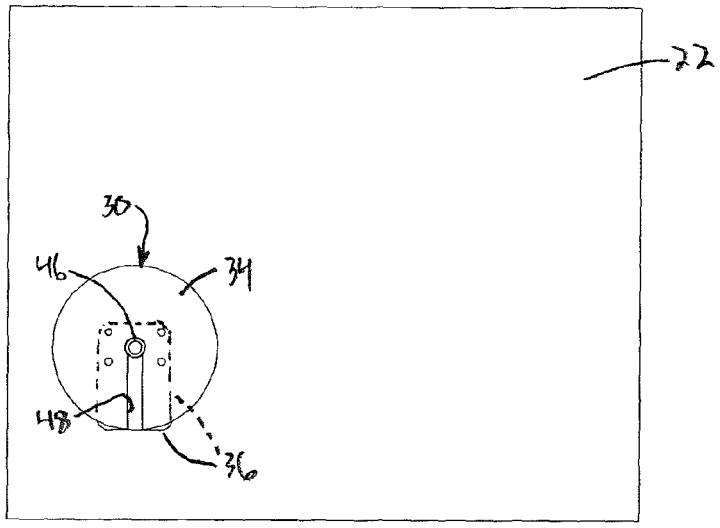
FIG. 4 is a view of the opposite side of the slide of FIG. 3.
Figure 5:
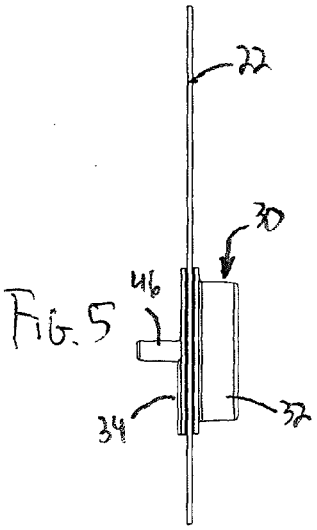
FIG. 5 is a side elevational illustration of the slide shown in FIG. 3.
Figure 11:
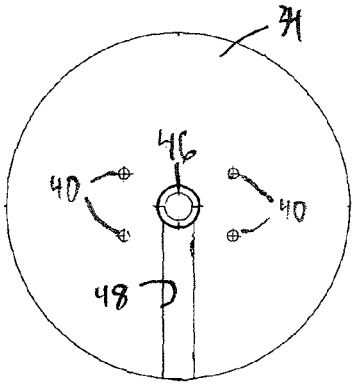
FIG. 11 is an enlarged elevational view of the backing for the knob shown in FIG. 3.
Figure 12:
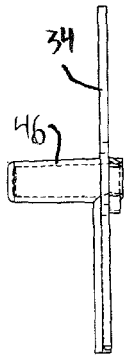
FIG. 12 is a side elevational view of the backing shown in FIG. 11.
Figure 13:
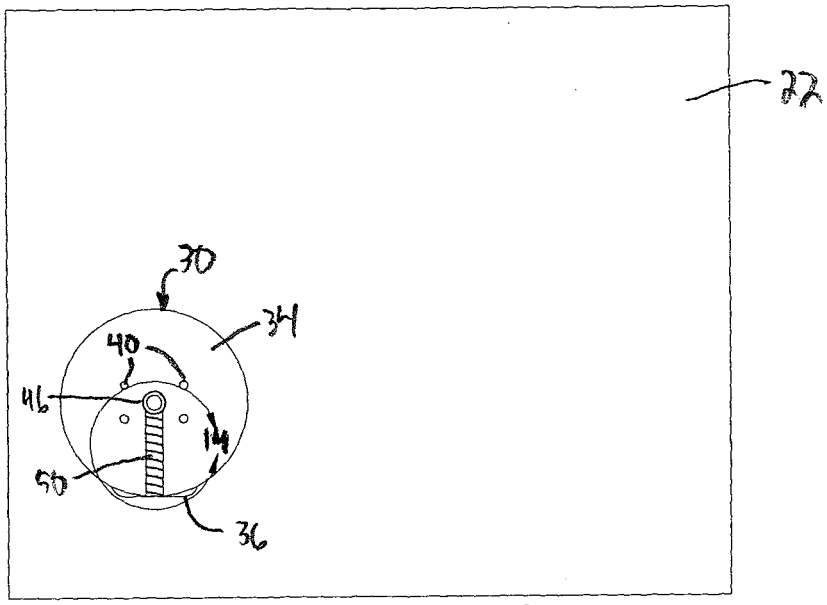
FIG. 13 is a view similar to FIG. 4, but also showing the biasing spring for the knob.
Figure 14:
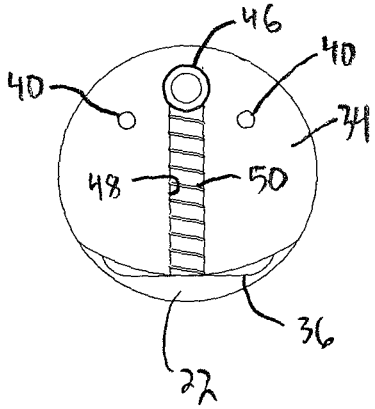
FIG. 14 is an enlarged view taken along cut away 14 of FIG. 13.
Figure 15:
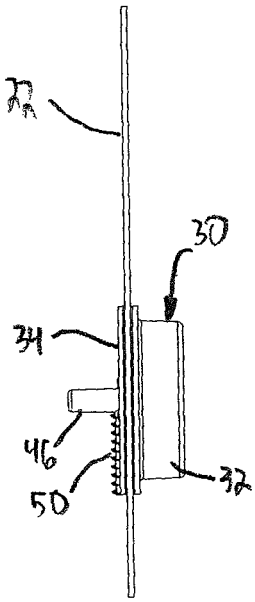
FIG. 15 is a side elevational illustration similar to FIG. 5, but also illustrating the biasing spring.

The slide 22 has a knob 30 mounted therein. The knob 30 includes two basic portions, a grip 32 and a backing 34. The grip 32 and backing 34 of the knob 30 are preferably molded from plastic for easy installation and assembly, although other materials can be used. When the knob 32 is assembled on the slide 22, it is installed in an aperture 36 formed therein, as best shown in FIG. 4.

Figure 10:
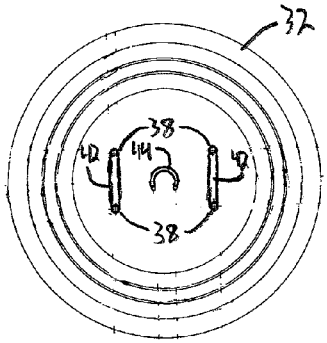
FIG. 10 is a rear elevational view of the grip shown in FIG. 6.
Figure 3:
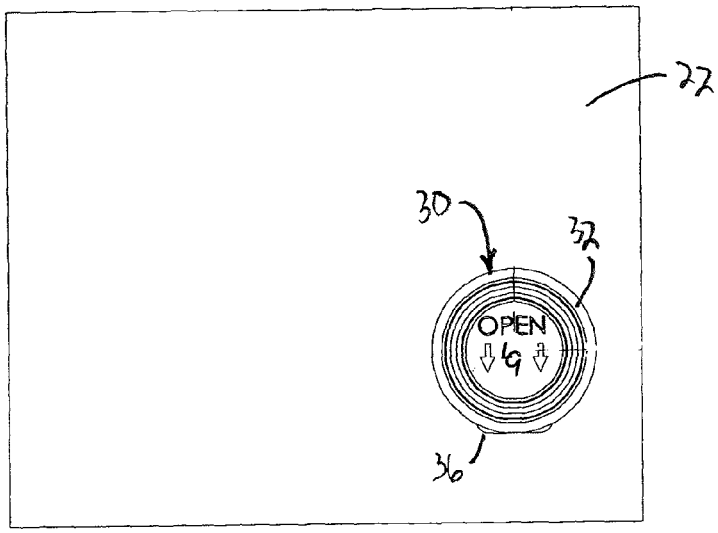
FIG. 3 is an enlarged view of the slide of the panel according to the invention, taken from one side.

The grip 32 includes four prongs 38 which are in registration with corresponding holes 40 in the backing 34. A land 42 extends between adjacent pairs of the prongs 38, as best shown in FIG. 10. When the knob 30 is assembled, the prongs 38 extend into the holes 40 and may be permanently affixed therein by heating, gluing or any appropriate means. The lands 42 provide a sufficient separation between the grip 32 and backing 34 so that it may be displaced in the aperture 36 to open the door 10, as described in greater detail below.

The grip 32 also includes a central extension 44 which engages within a latch strike in the form of a finger 46 in the backing 34 when the knob 30 is assembled.

As mentioned above, the knob 30 is assembled in an aperture 36 in the slide 22. The horizontal spacing between the lands 42 is slightly less than the width of the aperture 36 to allow the knob 30 to be displaced vertically in the aperture 36. In a normal or actuation orientation, however, the knob 30 is displaced upwardly to the greatest extent in the aperture 36. To facilitate that location, the backing 34 includes a channel 48. An extension spring 50 is seated in the channel 48, bearing between the top of the channel 48, which is a knob contact proximate the finger 46 and the bottom of the aperture 36, which is its slide contact. The force of the spring 50 normally maintains the knob 30 in the orientation shown in FIGS. 3-5 and 13-15.

Figure 6:
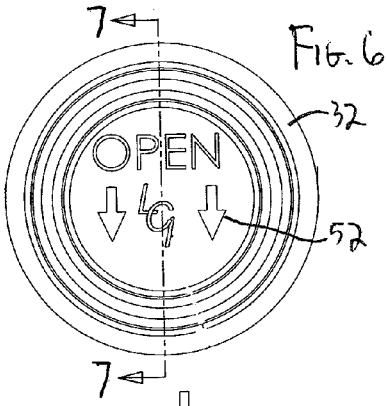
FIG. 6 is an enlarged view of the grip portion of the knob shown in FIG. 3.
Figure 7:
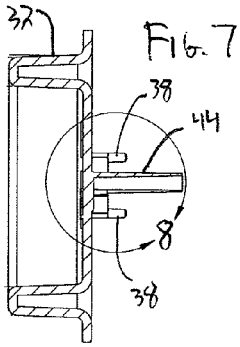
FIG. 7 is a cross sectional illustration taken along lines 7-7 of FIG. 6.
Figure 8:
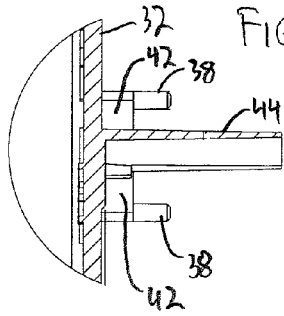
FIG. 8 is an enlarged view taken along cut away 8 of FIG. 7.
Figure 9:
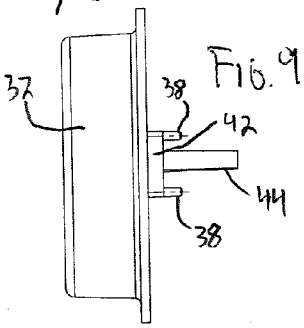
FIG. 9 is a side elevational view of the grip shown in FIG. 6.

The invention provides two ways of opening the door 10. In a first, conventional fashion, the user grasps the grip 32 and moves the slide horizontally in the tracks 24 and 26 over the fixed portion 20, thus exposing the latch 16. The latch 16 can then be engaged to open the door 10. In a second fashion, and as indicated by the indicia 52 shown best in FIG. 6, the user grasps the grip 32 and depresses it in the direction shown by the arrows of the indicia 52. This movement therefore compresses the spring 50 and the finger 46 engages the latch 16, thus releasing the latch and allowing the door to be pushed open by the user without further engaging the latch 16. Once the user releases the grip 32, the knob 30 is returned, by the bias of the spring 50, to be raised or actuation orientation shown in the drawing figures.

While a spring 50, in the form of a coil spring, is shown as the means to maintain the knob 30 in the actuation orientation, other biasing means can be used, as well. For example, a leaf spring can be employed, bearing against the finger 46. Similarly, in place of a coil spring 50, a compressible, resilient material could also be used.

The panel 18 is illustrated with the fixed portion 20 and slide 22 being of approximately equal sizes. It will be evident that one or the other can be larger or smaller, depending on the size of the door 10 and the panel aperture that may be required to a person to physically engage the latch 16.

Various changes can be made to the invention with departing from the spirit thereof or scope of the following claims.

What is claimed is:

1. A combined slide access and latch engagement for a door, comprising, a. a door having a latch on one side, b. a panel in the door proximate the latch, the panel including a slide displaceable to permit access to the latch through a panel opening, c. a knob located on the slide, the knob including i. a grip protruding from one side of the slide, ii. a backing on an opposite side of the slide and secured to the grip through an aperture in the slide, and iii. a latch strike extending from the backing in registration with the latch when the slide is in a closed position, and d. a bias maintaining the knob in an actuation orientation.

2. The combined slide access and latch engagement according to claim 1, in which the latch strike comprises a finger protruding from the knob.

3. The combined slide access and latch engagement according to claim 1, in which the bias comprises a spring.

4. The combined slide access and latch engagement according to claim 3, in which the spring is mounted in a channel in the knob.

5. The combined slide access and latch engagement according to claim 4, in which the spring extends in the channel between a slide contact and a knob contact.

6. The combined slide access and latch engagement according to claim 5, in which the knob contact is proximate the latch strike.

7. The combined slide access and latch engagement according to claim 5, in which the slide contact comprises a portion of an opening in the slide.

8. A combined slide access and latch engagement for a door, comprising a. a panel for a door, the panel including a slide displaceable to permit access to a door latch through an opening in the panel, b. a knob located on the slide, the knob including i. a grip protruding from one side of the slide, ii. a backing on an opposite side of the slide and secured to the grip through an aperture in the slide, and iii. a latch strike extending from the backing, and c. a bias maintaining the knob in an actuation orientation.

9. The combined slide access and latch engagement according to claim 8, in which the latch strike comprises a finger protruding from the knob.

10. The combined slide access and latch engagement according to claim 8, in which the bias comprises a spring.

11. The combined slide access and latch engagement according to claim 10, in which the spring is mounted in a channel in the knob.

12. The combined slide access and latch engagement according to claim 11, in which the spring extends in the channel between a slide contact and a knob contact.

13. The combined slide access and latch engagement according to claim 12, in which the knob contact is proximate the latch strike.

14. The combined slide access and latch engagement according to claim 12, in which the slide contact comprises a portion of an opening in the slide

* * * * *

UNITED STATES PATENT AND TRADEMARK OFFICE
Certificate

Patent No. 8,794,683 B2 Patented: August 5, 2014

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: David R. Wysong, Goshen, IN (US); and Gary A. Eck, Mishawaka, IN (US).

Signed and Sealed this Thirtieth Day of September 2014.

PIERRE-LOUIS DESIR
*Supervisory Patent Examiner*
Art Unit 2659
Technology Center 2600

UNITED STATES PATENT AND TRADEMARK OFFICE
Certificate

Patent No. 8,794,683 B2 Patented: August 5, 2014

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: David R. Wysong, Goshen, IN (US); and Gary A. Eck, Mishawaka, IN (US).

Signed and Sealed this Fourth Day of November 2014.

KRISTINA R. FULTON
*Supervisory Patent Examiner*
Art Unit 3675
Technology Center 3600